US007328533B1

(12) United States Patent
Coleman

(10) Patent No.: US 7,328,533 B1
(45) Date of Patent: Feb. 12, 2008

(54) WINDOW SHUTTER OPENING AND CLOSING DEVICE

(76) Inventor: David Harold Coleman, 5608 Zoram Ct., Sacramento, CA (US) 95841

( * ) Notice: Subject to any disclaimer, the term of this patent is extended or adjusted under 35 U.S.C. 154(b) by 420 days.

(21) Appl. No.: 10/899,555

(22) Filed: Jul. 26, 2004

(51) Int. Cl.
*E06B 7/08* (2006.01)

(52) U.S. Cl. ..... 49/74.1; 49/82.1

(58) Field of Classification Search ..... 49/73.1, 49/74.1, 82.1, 87.1, 139, 140, 403
See application file for complete search history.

(56) References Cited

U.S. PATENT DOCUMENTS

| | | | | | |
|---|---|---|---|---|---|
| 7,203 | A * | 3/1850 | Williams | 49/74.1 |
| 439,912 | A * | 11/1890 | Ward | 49/74.1 |
| 2,327,246 | A * | 8/1943 | Bunjes | 49/77.1 |
| 2,574,729 | A * | 11/1951 | Coffman | 280/727 |
| 2,589,647 | A * | 3/1952 | Gelder et al. | 49/82.1 |
| 2,651,085 | A * | 9/1953 | Kopp | 49/64 |
| 2,690,336 | A * | 9/1954 | Belmont | 49/82.1 |
| 2,700,803 | A * | 2/1955 | Graham | 49/86.1 |
| 2,733,486 | A * | 2/1956 | Peeples | 49/82.1 |
| 2,774,590 | A * | 12/1956 | Blanchard | 49/82.1 |
| 5,191,735 | A * | 3/1993 | Ross | 49/74.1 |
| 6,014,839 | A * | 1/2000 | Ruggles | 49/74.1 |
| 6,568,131 | B1 * | 5/2003 | Milano, Jr. | 49/82.1 |
| 6,854,211 | B1 * | 2/2005 | Blachley | 49/82.1 |
| 2006/0272214 | A1 * | 12/2006 | Simonelli et al. | 49/92.1 |

* cited by examiner

*Primary Examiner*—Jerry Redman
(74) *Attorney, Agent, or Firm*—Risto A. Rinne, Jr.

(57) ABSTRACT

An apparatus for opening and closing window shutter slats or louvers converts rotary motion by a knob or electric motor into rotary motion of one of the slats. The apparatus is attached to a frame structure that is included with the window shutter and which surrounds the slats. A connecting rod that is pivotally attached to all of the slats pivots all of the slats an amount that is nearly equal to that of the one slat. The knob includes a first shaft that is attached to a drive gear in an enclosure which turns a driven gear. The driven gear is attached to a second shaft which is adapted to turn a pin end of the one slat. The motor is adapted to rotate one of the slats directly. Retrofit use and use in newly manufactured shutters is described. The apparatus can also be used to pivot open the shutter with respect to a pair of hinges that pivotally attach the shutter to a surrounding support structure.

12 Claims, 2 Drawing Sheets

WINDOW SHUTTER OPENING AND CLOSING DEVICE

BACKGROUND OF THE INVENTION

1. Field of the Invention

The present invention, in general, relates to window shutters and, more particularly, to a device for opening and closing indoor window shutters.

Window shutters, sometimes also known as "Plantation shutters", include a plurality of spaced-apart parallel horizontal slats (i.e., louvers) that are each pivotally supported within a frame structure that surrounds the slats. Each slat is supported by two pins that protrude from opposite ends of the slats and extend into openings provided in the frame. The terms "slat" or "slats", as used herein, are synonymous with the terms "louver" or "louvers", respectively, as they apply to window shutters.

A connecting bar is pivotally attached to each of the slats so that when either the connecting bar or any one of the slats is moved (i.e., pivoted), all of the slats move accordingly and in unison. The connecting bar extends vertically up and down and is pivotally attached to one side (or both sides, as it is possible to use two connecting bars) of the slats or, if preferred, vertically along a center length of the slats.

The window shutters are used as a window treatment, most often to control an amount of light entering a room, and the slats are pivoted together to control the amount of light that is entering the room or to obstruct the view through the window, for example, when greater privacy in the room is desired. The slats are all pivoted in unison so that they are all fully open, all fully closed, or all somewhere in-between, as desired.

The slats are substantially flat planar members. When fully open a center plane of all of the slats is substantially level (i.e., parallel) with respect to a plane of the earth's surface. In this position, the slats are viewed on edge from inside of the room and they each then minimally block the view through the window, or the view of the window itself as they are usually disposed in front of the window. Maximum light is then able to enter the room from the outside. When the slats are viewed on edge, they are in an open position.

When the slats are in a closed position, the upper and lower edges of the intermediate slats slightly overlap one another, and the center plane of each slat is perpendicular or nearly perpendicular (i.e., vertical or nearly vertical) with respect to the plane of the earth. The top and bottom slats do not have both edges overlap in the closed position. Rather, when the slats are in the closed position, the bottom edge only of the top most slat overlaps the top edge of the slat that is disposed below it and the top edge only of the bottom most slat overlaps the bottom edge of the slat that is disposed above it.

In this, the closed position, the slats appear to combine together to form a large extended and somewhat thicker planar surface that maximally obstructs light entering the room, the view through the window, as well as sight of the window. When the slats are perpendicular or nearly so, they are said to be in the closed position.

Certain types of modern window shutters are made of durable and energy saving materials. They may be mounted within an existing window frame or they may include a surrounding frame structure that supports the frame structure. The surrounding frame structure extends generally around a window opening. The frame structure (i.e., that portion which surrounds the slats) usually includes hinges about which it pivots away from the window opening or away from surrounding frame structure, for access to the window itself, i.e., for cleaning or opening and closing of the window.

The frame structure may also include a perimeter seal that helps provide an air-tight seal intermediate a perimeter of the frame structure and the window opening (or surrounding frame structure) to block light and also to better seal the window opening. This prevents drafts and increases the effective "R" factor, or insulation value proximate the window.

The slats can also be adjusted anywhere in between the fully open or fully closed position to better regulate the amount of light (or air) entering into the room.

There are numerous problems associated with window shutters. First, to open or close the shutter slats, the common connecting bar, depending upon where it is located, may be grasped and urged up or down, either from the fully open to the fully closed position (or in reverse) or to some location between the two positions.

It is also possible with certain types of window shutters to continue to raise the connecting bar beyond the fully open (i.e., horizontal) position and to partially close the slats with a slope that is in an opposite direction compared to that which occurs when the connecting bar is in a lowered position. In either position, the connecting bar is used to regulate the position of all of the slats simultaneously.

Alternately, any one of the slats can also be grasped and urged to pivot, which will cause all of the slats to pivot as well because the connecting bar transfers the force that is being applied to pivot one of the slats to all of the remaining slats.

The same connecting bar, again depending on which side of the slats it is disposed on, may also be grasped and pulled in a direction that is generally away from the window (i.e., toward the interior of the room) to open the shutter itself by pivoting the frame that supports the slats about a vertical axis that is provided by a plurality hinges. When the frame (which includes all of the slats) is closed, it is disposed within the surrounding support structure or, alternately, in an existing window frame opening. The window opening can then serve as an alternate support structure to enclose, or partially enclose, the frame, as desired.

One of the most common failures with most types of window shutters is that the connecting bar can break. It simply cannot repeatedly handle over time the force that is required to pull the shutter frame out of the surrounding support structure or to pull the shutter frame out of the alternate support structure without eventually detaching at least a portion of the connecting bar from certain of the slats.

Furthermore, an increase in friction between the frame and the surrounding support structure or the alternate surrounding support structure can occur from a variety of causes, for example, a settling of a house foundation, or warping of the frame or surrounding support structure, or any other shifting of the surrounding support structure.

This increase in friction is also known as "binding" of the frame to its surroundings and in order to open or close the frame a substantial increase in the magnitude of force that is applied to the connecting bar may be required. Increasing the force applied to the connecting bar is especially likely to cause eventual breakage. It is not only the connecting bar itself that is subject to breakage (i.e., failure) but equally troublesome is a failure of the connection between the connecting bar and any of the slats.

Also, because the connecting bar may perform double duty; first, to regulate the position of the slats and second, to open or close the entire shutter (i.e., to pivot the shutter frame about the vertical axis), the connecting bar is subject to failure because such a high duty cycle is often more than the connecting rod can sustain.

It is important to note that regardless of whether the slats are in an open or closed position, the vertical connecting bar is present and can be seen. Sometimes, the connecting bar is disposed at an end of the slats where it is pivotally connected to each slat (using a protrusion that passes into the slat or a protrusion from the slat that passes into the connecting bar, about which each slat can pivot). Sometimes, the connecting bar is disposed along the length of the slats where it is almost always disposed on a front side of the slats, that is, on a side that is the same as that of an interior of the room where it can be grasped and used to open and close the slats and also to open and close the frame. If desired, the connecting bar can be disposed on a back side of the slats, that is, on a side opposite that of an interior of the room.

However, regardless of where the connecting bar is located, when the slats are open, at least some portion of the connecting bar is visible and the smaller it is, in general, the less objectionable is its appearance. Accordingly, there is a tendency to make the connecting bar as small as possible. This tendency provides for a weaker connecting bar. Furthermore, when the connecting bar is disposed on the back of the slats, it is unavailable to grasp and use to open or close the slats or to pivot the frame open or closed.

When the connecting bar is used to open the shutter frame, a poor mechanical advantage occurs when the connecting bar is pulled or pushed to pivot the frame about its vertical axis because the slats are disposed within a center opening of the frame and therefore, the connecting bar cannot be maximally disposed away from the vertical hinges that the frame pivots about.

Accordingly, a greater force attempting to pull the shutter away from the window or push it toward the window must then be applied to the connecting rod which puts even greater stress on the connecting rod at the points of attachment intermediate the connecting rod and the slats which again contributes to premature breakage of the connecting rod itself or at the attachment points where the connecting rod is attached to the slats.

When the connecting bar is attached to the slats along the length of the slats, loops are often provided in the connecting rod that encircle similar types of loops that are provided in each of the slats, thereby allowing the connecting rod to pivot with respect to the slats as it is moved up or down and to interconnect all of the slats so that they pivot in unison.

To open or close the slats, any one of the slats can then similarly be urged up or down which causes all of the slats to be similarly pivoted. This also tends to dirty the slats.

An alternate and common way to open the shutter frame about its vertical axis is to grasp one of the open or partially open slats, and pull on it with sufficient force to pivot open the frame about the hinges. Because the slats are disposed within the frame, it is impossible to obtain an optimum mechanical advantage in opening the frame when pulling on any of the slats. Optimum mechanical advantage would occur if pulling were to occur on an outside portion of the frame (distally away from the hinges).

Pulling on the slats to pivot open the frame also contributes to much breakage because the slats are pivotally attached to the frame by the pins that extend from the slat ends into holes provided in the frame. These pins are small and relatively weak. Pulling on the slats subjects the pins to severe stress which tends to cause breakage of the pins because they, similarly, cannot handle the forces that are applied. Alternately, if the pins do not break, they can be dislodged out of the frame holes, thereby rendering them inoperative. Furthermore, grasping the slats tends to dirty the slats, which detracts from their appearance.

Also, the slats themselves tend to become loose over time because the pins tend to loosen in the holes in which they fit. Accordingly, when the slats are disposed in an open or partially open position, they tend to fall down under their own weight plus the weight of the connecting rod until they are in either a closed or open position, depending on which side of the slats the connecting rod is located. The slats tend to pivot about a center longitudinal axis (i.e., through the center of the pin that extends from both ends of each slat into the frame). As such, the slats are reasonably well balanced. However, the connecting rod is attached to a common side of all of the slats. The weight of the connecting rod introduces substantial imbalance to the slats. It is this imbalance that tends to cause the slats to fall down and close after the pins have become worn and loose and friction in the system is lessened by wear.

It is, therefore, not uncommon to see home and business owners using pieces of cardboard or paper as wedges that are placed between the ends of their window shutter slats and the interior of the frame to bind the slats in position and thereby, hold the slats in the desired open position or partially open position. Of course, the wedges can also become loose or be dislodged, causing the slats to once again fall into the closed position.

It is not possible, generally, for all of the slats to be disposed at a truly vertical angle with respect to the earth because the top of one slat will contact the bottom of a slat that is above it. This is because the slats include a slight overlap in the vertical position. A slight offset away from vertical of a center plane of the slats is common in the fully closed positions.

The slats for certain types of shutters are flat planar members. They may include a generally oval or rectangular cross-section or other shape, as desired. If desired, the slats may each include a slight curvature (not common) across a relatively narrow width and where the curvature extends along the longitudinal length of each slat.

The plane of the slats, as mentioned herein, is either the plane extending through a center of the flat planar members (slats) or it may include a chord extending across the slight curvature that is being referred to.

The terms "close" or "closed" refers to orienting the plane of the slats (or the chord of the slats) at an angle as far from parallel with respect to the plane of the earth as is possible for the slats or, stated another way, as nearly vertical or perpendicular with respect to the earth as is possible, thereby substantially preventing light from entering into the room when the frame of the window shutters are installed in a common fashion that is parallel with respect to a plane of the window itself.

Accordingly, there exists today a need for a window shutter opening and closing device that helps ameliorate the above-mentioned difficulties.

2. Description of Prior Art

Window shutters are, in general, known. While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a window shutter opening and closing device that is adapted to assist in the closing of a window shutter from a closed position where a frame is disposed in a substantially parallel position proximate a window into an open position, where the frame is disposed at an angle that is not parallel to the plane of the window.

It is also an important object of the invention to provide a window shutter opening and closing device that is adapted for retrofit use with existing types of window shutters.

Another object of the invention is to provide a window shutter opening and closing device that is adapted for use with existing types of window blinds which include a vertical connecting rod that is attached to a plurality of slats (i.e., louvers).

Still another object of the invention is to provide a window shutter opening and closing device that is adapted to attach to a frame of a window shutter, the frame being adapted to support a plurality of pivotable slats.

Still yet another object of the invention is to provide a window shutter opening and closing device that improves a mechanical advantage when pivoting a shutter frame into an open or closed position about a vertical axis.

Yet another important object of the invention is to provide a window shutter opening and closing device that includes a member that is adapted to rotate at least a portion of a circle about a horizontal axis and including means for converting the rotation of the member along the horizontal axis into rotation of a slat about a slat axis.

Still yet another important object of the invention is to provide a window shutter opening and closing device that includes a knob that is maximally disposed away from a vertical hinge axis that a shutter frame is adapted to pivot on.

A first continuing object of the invention is to provide a window shutter opening and closing device that includes a knob that is adapted to rotate about a center axis with respect to a frame, the frame being adapted to secure a plurality of slats that are each adapted to pivot about a slat axis with respect to the frame, sufficient so that when the knob is rotated about its center axis, at least one of the slats pivots about its slat axis.

A second continuing object of the invention is to provide a window shutter opening and closing device that includes a knob that is adapted to rotate about a center axis with respect to a frame, the frame being adapted to secure a plurality of slats that are each adapted to pivot about a slat axis with respect to the frame, sufficient so that when the knob is rotated about its center axis, all of the slats pivot about their respective slat axes.

A third continuing object of the invention is to provide a window shutter opening and closing device that is adapted to pivot a slat about a slat axis without a user touching the slat.

A fourth continuing object of the invention is to provide a window shutter opening and closing device that is adapted to pivot a slat about a slat axis intermediate an open position and a closed position.

A fifth continuing object of the invention is to provide a window shutter opening and closing device that is adapted to pivot a slat within a frame that supports the slat and which is adapted to pivot a slat about a slat axis intermediate an open position and a closed position for the slat within the frame and which can also be used to urge the frame intermediate an open and a closed position for the frame with respect to a window.

A sixth continuing object of the invention is to provide a window shutter opening and closing device that helps retain a plurality of slats in a desired position.

A seventh continuing object of the invention is to provide a window shutter opening and closing device that eliminates the need to use a connecting bar to urge a window shutter frame intermediate an open or closed position with respect to a window.

An eighth continuing object of the invention is to provide a window shutter opening and closing device that makes it more convenient to open or close a plurality of slats.

A ninth continuing object of the invention is to provide a window shutter opening and closing device that better controls the position of a plurality of slats.

A tenth continuing object of the invention is to provide a window shutter opening and closing device that eliminates the need to use a connecting bar to urge a plurality of slats of a window shutter intermediate an open or closed position.

An eleventh continuing object of the invention is to provide a window shutter opening and closing device that is adapted for inclusion with newly manufactured window shutters.

A twelfth continuing object of the invention is to provide a window shutter opening and closing device that helps maintain the slats clean for an extended period of time.

Briefly, a window shutter opening and closing device that is constructed in accordance with the principles of the present invention is adapted for use with window shutters of the type that have a frame which surrounds a plurality of pivotable slats. The frame includes a plurality of pairs of parallel and opposite holes on an inside thereof. A pin is attached to and protrudes from an opposite end of each slat. Each pin fits into one of the holes of each pair of holes in the frame. The slats are adapted to each pivot about a slat axis that passes through a longitudinal center of each pair of pins with respect to the frame. A vertical connecting rod is pivotally attached to each of the slats whereby movement of the connecting rod up or down is used to urge all of the slats simultaneously from a closed (down) position into an up, or open, position or, alternately, movement of any one of the slats is transferred through the connecting rod to cause all of the slats to pivot a proportional amount, as well. According to the instant invention, a first shaft passes through an exterior device opening that is provided through the frame. A knob is attached to a first end of the first shaft at a frame exterior. A drive gear is attached to an opposite second end of the first shaft inside the frame. A second shaft is disposed at a right angle with respect to the first shaft. The second shaft includes a driven gear that is attached at a first end of the second shaft. The driven gear is cooperatively engaged with the drive gear so that rotation of the drive gear will produce rotation of the driven gear about the second shaft. An opposite second end of the second shaft is cooperatively attached to one of the pins. Therefore, rotation of the knob produces rotation of one of the slats which, in turn, produces rotation of all of the slats. The window shutter opening and closing device is adapted for use in new manufacture and for retrofit usage in most existing types of window shutters.

DETAILED DESCRIPTION OF THE INVENTION

Figure 1:
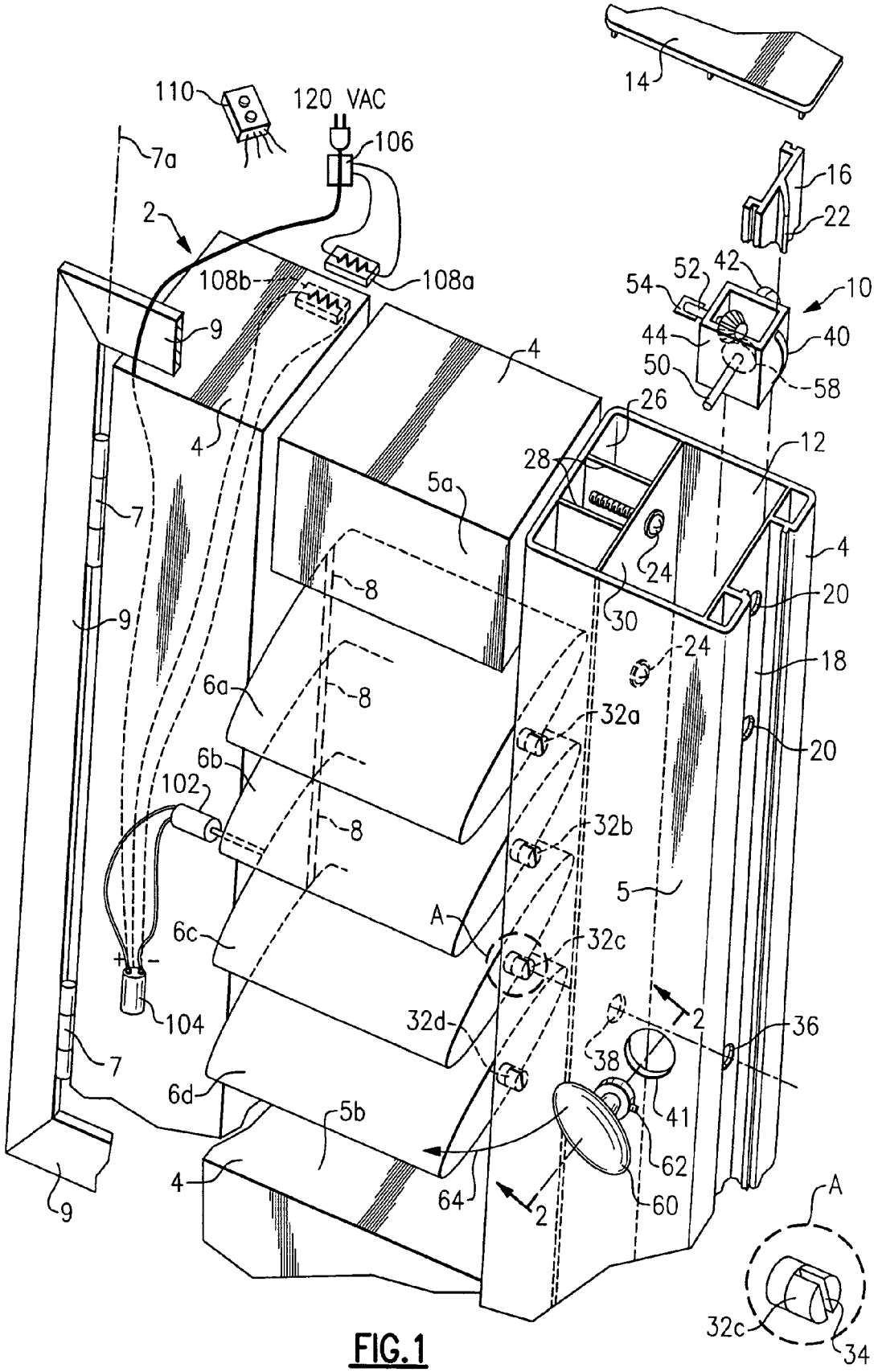
FIG. 1 is a view in perspective of a window shutter opening and closing device being installed on a window shutter, an upper portion of the shutter being shown.

Referring to FIG. 1 is shown, a prior art type of a window shutter, identified in general by the reference numeral 2. The shutter 2 is of a common type, available for residential and commercial use and it provides an environment for use of the instant invention, as is described in greater detail hereinafter.

The shutter 2 includes a frame structure 4 (partially shown) that surrounds a plurality of slats 6*a*-6*d*. Any number of additional slats (not shown) are included within the frame 4 as is desired. All slats 6*a*-6*d* are in a parallel, spaced-apart relationship with respect to each other. Also, the slats 6*a*-6*d* may include any longitudinal length that is necessary to span the width of a window opening (or part of a window opening if more than one shutter 2 is used to cover the window opening). The slats 6*a*-6*d*, as shown, are somewhat short to provide room in the drawing figure to include other details that are of importance to an overall understanding of the instant invention. The slats 6*a*-6*d* are also sometimes referred to as louvers.

A connecting rod 8 is pivotally attached to each slat 6*a*-6*d*, as desired. A preferred way it to use a protrusion that pivotally attaches the connecting rod 8 to an end of each slat 6*a*-6*d*, whereby the connecting rod 8 is able to move up and down with respect to the frame 4. As the connecting rod 8 moves up or down, it is adapted to pivot with respect to each slat 6*a*-6*d* at the point of pivotal attachment.

Other methods (i.e., loops, not shown) may also be used to pivotally attach the connecting rod 8 to each of the slats 6*a*-6*d*. The connecting rod 8 may include a one-piece member or it may include a plurality of segments, each segment pivotally attached to one of the slats 6*a*-6*d*, wherein the segments are adapted to connect together to form an overall longer type of the connecting rod 8. If preferred, a plurality of smaller connecting rods can be used to pivotally link any two of the slats 6*a*-6*d* together in pairs. Additional smaller connecting rod can be located where desired, apart from each other or proximate each other, and used to link either of the pair of slats 6*a*-6*d* that is already linked together with yet another slat 6*a*-6*d*, and so on, etc. until all of the slats 6*a*-6*d* are linked together.

A pair of hinges 7 define a vertical axis 7*a* (dashed line 7*a*) that passes through the center of the hinges 7. The hinges 7 pivotally attach the frame 4 to a surrounding support structure 9. the surrounding support structure 9 is then attached over and around the perimeter of a window opening. If desired, the surrounding support structure 9 can be eliminated and the hinges 7 and frame 4 can be pivotally attached directly to any preferred member of the window opening. When the term surrounding support structure 9 is used herein, it is intended to include either a separate structure that surrounds the window opening or some portion of the window opening itself.

Figure 2:
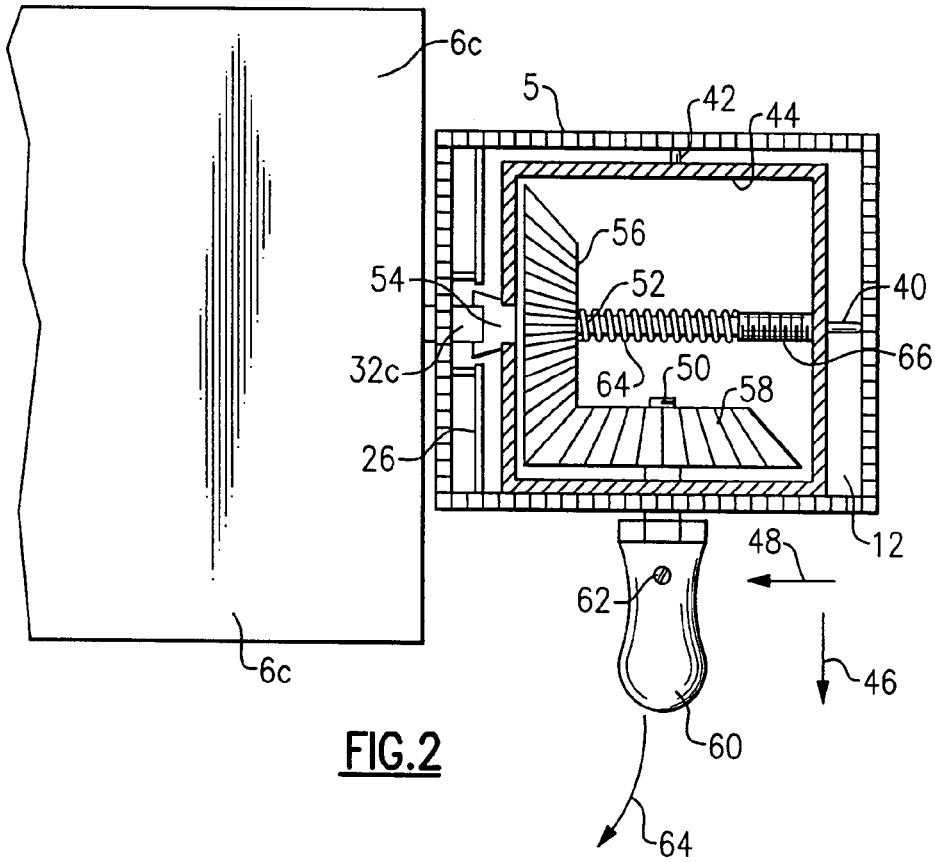
FIG. 2 is a cross section view of taken along the line 2-2 of FIG. 1 with the gear assembly and knob of FIG. 1 having been installed.

The instant invention that improves upon the window shutter 2 is a window shutter opening and closing device, identified in general by the reference numeral 10. The window shutter opening and closing device 10 is adapted for use with the window shutter 2. The window shutter opening and closing device 10 is adapted for use, as disclosed herein in FIG. 3, for inclusion in newly manufactured window shutters 2 and also for retrofit use in already manufactured shutters 2, as shown in FIGS. 1 and 2. Additional discussion about the structure of the shutter 2 follows prior to a detailed discussion of the use of the window shutter opening and closing device 10.

The window shutter opening and closing device 10 is shown above a vertical longitudinal channel 12 that is provided distally away from the hinges 7 at a distal frame member 5. The distal frame member 5 is part of the overall frame 4. A cap 14 has been pried off the top of the channel 12 and is partially shown above the channel 12 and right portion of the frame 4, in a partially exploded view.

Disposed immediately below the cap 14 is partially shown a portion of a cover member strip 16 that fits in an outermost channel 18 of the frame 4. The cover strip 16 is adapted to slide up and out of the outermost channel 18 (or back in) after the cap 14 has first been removed.

Longitudinal ears on each side of the outermost channel 18 engage with a pair of longitudinal recesses in the cover strip 16 to guide and retain it in place. The cover strip 16 is used to provide access to mounting screw holes 20 that are provided in the outermost channel 18. The cover strip 16 also provides a finished covering for the outermost channel 18 when it is installed and a longitudinal weather strip 22 extends from the cover strip 16 to provide a seal intermediate the frame 4 and the surrounding support structure 9 when the frame 4 is in a closed position (i.e., adjacent and parallel with respect to a window).

A pair of mounting screw holes 20 are provided at the top and another pair at the bottom of the outermost channel 18 and are used to secure distal frame member 5 to an upper vertical frame member 5*a* and a corresponding lower frame member 5*b* by the use of a pair of mounting screws 24. The mounting screw holes 20 provide access to heads of the mounting screws 24 after the cover strip 16 has been removed.

The distal frame member 5 is a generally hollow rectangular longitudinal member that extends from top to bottom of the shutter 2. On a side opposite that of the outermost channel 18 is an interior side 26 of the distal frame member 5.

A pair of intermediate members 28 are disposed perpendicular with respect to the interior side 26 and are attached thereto. The intermediate members 28 extend in a parallel spaced-apart relationship with respect to each other within the channel 12 a short distance and are attached at an opposite end each to a cross member 30. Screw holes are provided in the cross member 30 through which each mounting screw 24 passes.

The intermediate members 28 provide additional support so that when the mounting screws 24 are tightened, the cross member 30 is not crushed and pulled too close to the upper vertical frame member 5*a* or to the lower frame member 5*b*. While there are many materials and methods by which the shutter 2 or any of its component parts can be made, extrusion is one preferred way. Accordingly, the distal frame member 5 may be extruded from any preferred material, for example, plastic, aluminum, etc.

Each slat 6*a*-6*d* includes a pair of extension pins 32*a*-32*d*, respectively, on each end thereof. The extension pins 32*a*-32*d* that are disposed on a side of the slats 6*a*-6*d* closest to the distal frame member 5 fit into holes that are provided in the interior side 26 member. Corresponding holes are provided in an opposite side of the frame 4 closest to the hinges 7 that receive and support the remaining extension pins 32*a*-32*d*. Accordingly, each slat 6*a*-6*d* is adapted to pivot in the frame. The connecting rod 8 connects all of the slats 6*a*-6*d* together so that they all pivot in unison when any of them are pivoted or when the connecting rod 8 is urged up or down.

Referring momentarily to Inset A in FIG. 1, the pins 32*a*-32*d* preferably each include a slotted recess 34 at each end thereof. If the slotted recess 34 is not included in the pins 32*a*-32*d* it can be included at the specific pin 32*a*-32*d* where required by cutting an end of the pin 32*a*-32*d* with a saw, for example.

The slotted recess 34 is provided for a number of reasons. It makes the pins 32*a*-32*d* easier to insert into the holes in the frame 4 because the end can compress slightly. It also helps retain the pins 32*a*-32*d* in the holes in the frame 4 because, after insertion in the holes, the ends of the slotted recesses 34 tend to flare apart.

The slotted recesses 34 are similar to the head of a type of a screw (not shown) that is adapted for turning with a flat blade screwdriver. Although the slotted recesses 34 are not included in the pins 32*a*-32*d* for that purpose, if a flat object, like a flat blade screwdriver were inserted in one of the slotted recesses 34 and then turned, the slats 6*a*-6*d* would all pivot. All of the slats 6*a*-6*d* would pivot because of their interconnection by the connecting rod 8 regardless which one of the slats 6*a*-6*d* was being turned by the screwdriver.

To retrofit the window shutter opening and closing device 10 to the shutter, the cap 15 is removed from the distal frame member 5. The cover strip 16 is then removed from the outermost channel 18. An appropriate size and type of screwdriver (either flat blade or Phillips) is inserted through the mounting holes 20 and the two upper and the two lower mounting screws 24 are loosened sufficient to pull the distal frame member 5 away from the rest of the frame 4. When the distal frame member 5 is urged away from the rest of the frame 4, the pins 32*a*-32*d* of the slats 6*a*-6*d* are also urged out from their respective holes in the interior side 26 of the distal frame member 5.

The window shutter opening and closing device 10 is adapted for installation in the channel 12 where it can be used to directly pivot any one of the slats 6*a*-6*d*. For this disclosure, the slat 6*c* is assumed to be the center one (not all of the slats are shown) and it is desired that the window shutter opening and closing device 10 be adapted for use with the center slat 6*c* for uniformity in appearance and also to aid in opening and closing the frame 5.

After the distal frame member 5 has been removed from the rest of the frame 4 and the slats 6*a*-6*d*, an additional device hole 38 in the cross member 30 that is longitudinal alignment with the center of the pin 32*c* of the center slat 6*c* is required. A portion of the window shutter opening and closing device 10 will later pass through the device hole 38.

The location of the device hole 38 can be determined by measuring down from the top of the distal frame member 5 in the outermost channel 18 an amount equal to the distance down from the top that the hole in the interior side 26 that the pin 32*c* of the center slat 6*c* passed through. The location is marked in the outermost channel 18 and a new access hole 36 is drilled in the outermost channel 18. The drilling operation is continued further into the distal frame member 5 until the device hole 38 has been drilled in the cross member 30 so that the device hole 38 is in alignment with the hole in the interior side 26 that the pin 32*c* of the center slat 6*c* passed through.

It is also possible to drill the device hole 38 by using the hole in the interior side 26 that the pin 32*c* of the center slat 6*c* passes through as a guide for a drill bit to pass into and then drilling through the cross member 30 to provide the required device hole 38.

A knob hole 41 is also measured and drilled through the distal frame member 5 so the knob hole 41 is in alignment with the device hole 38 and also so that it is centered in the channel 12, left to right.

After drilling is complete, the process used for disassembly of the distal frame member 5 is reversed and the distal frame member 5 is reattached to the rest of the frame 4 while taking care to ensure that the pins 32*a*-32*d* enter into their respective holes in the interior side 26.

Referring also now to FIG. 2, the window shutter opening and closing device 10 that is preferably designed for retrofit use includes a first outer spring clip 40 and a second outer spring clip 42 that is disposed outside of an enclosure 44. The window shutter opening and closing device 10 is then urged into the channel 12 and down. The spring clips 40 supply a pair of forces that tend to urge the window shutter opening and closing device 10 in the channel 12 in a direction as shown by arrows 46 and 48 simultaneously as it is being urged down into the channel 12.

When the window shutter opening and closing device 10 is lowered sufficiently far into the channel 12, the second spring clip 42 urges a first shaft 50 out of the knob hole 41. The first spring clip 40 then urges a second shaft 52 to enter into the device hole 38. A second end of the second shaft 52 proximate the pin 32*c* tapers to a flat end 54, similar to an end of a flat blade screwdriver. Its use is described in greater detail hereinafter.

A first end of the second shaft 52 extends into the enclosure 44 and is attached to a driven gear 56. The driven gear 56 is preferably a bevel type that is cooperatively engaged with a similar drive gear 58. The drive gear 58 is attached to a second end of the first shaft 50 in the enclosure 44. Accordingly, rotation of either the drive gear 58 or the driven gear 56 will cause rotation of the other gear 56, 58, in turn and also of the first shaft 50 and the second shaft 52 simultaneously.

A knob 60 passes over a first end of the first shaft 50 and is tightened thereto by a set screw 62. A flat portion may be provided in the first end of the first shaft 50 for the set screw 62 to engage with.

A tension spring 64 is preferably included in the enclosure 44 in alignment with the second shaft 52. The tension spring 64 supplies a force that urges the driven gear 56 toward the pin 32*c* of the center slat 6*c*. A tension screw 66 may be provided to adjust the tension applied to the driven gear 56 by the tension spring 64.

The driven gear 56 is able, due to tolerances within the enclosure 44, to be displaced slightly toward the drive gear 58 during installation.

The knob 60 is then rotated slightly which turns the drive gear 58 which turns the driven gear 56 which turns the second shaft 52, which turns the flat end 54 an amount sufficient for the flat end 54 to align with the slotted end 34 of the pin 32*c*. At that time, the tension spring 64 as well as force supplied by the first spring clip 40 (or either one if the other is eliminated) urges the flat end 54 into the slotted end 34. Motion of the driven gear 56 with respect to the drive gear 58 is limited in the enclosure 44 to ensure that the two gears 56, 58 always remain cooperatively engaged with each other.

Assuming that the drive gear 58 and the driven gear 56 have a one to one gear ratio, a turning of the knob 60 one-quarter of a revolution is sufficient to rotate the flat end 54 one-quarter of a turn as well. Rotation of the flat end 54 rotates the slotted end 34 which rotates the pin 32*c*, which rotates the center slat 6*c* nearly 90 degrees, or enough to move the center slat 6*c* from a fully closed position into a fully open position or from a fully open position into a fully closed position.

Because the connecting rod 8 interconnects all of the slats 6*a*-6*d*, rotating the knob 60 rotates all of the slats 6*a*-6*d* a proportional amount. Of course, a lesser or a greater rotation of the knob 60 than one-quarter turn can be used to proportionately regulate the position of the slats 6*a*-6*d*, as desired.

In addition to providing a method of opening and closing all of the slats 6*a*-6*d* without the need to touch any of the slats 6*a*-6*d* or the connecting rod 8, the window shutter opening and closing device 10 provides a method to pivot open the shutter 22 about the hinges 7 from a closed position proximate the window into an open position where the distal frame member 5 is maximally disposed away from the window.

To pivot open the frame 4, the knob 60 is grasped and is urged in a general direction as shown by arrow 64. To pivot the frame 4 back into the closed position, the knob 60 is urged in a direction opposite that as shown by arrow 64.

Accordingly, the window shutter opening and closing device 10 is used to easily open, close, or regulate the position of the slats 6*a*-6*d* and also to pivot open or to close the entire shutter 2 in a manner that prevents breakage and which also keeps the slats 6*a*-6*d* and the frame 4 maximally clean. Because the knob 60 is disposed a greater distance away from the hinges 7 than are any of the slats 6*a*-6*d*, the window shutter opening and closing device 10 also provides an increase in mechanical advantage when the knob 60 is used to pivot open the shutter 2 and also when it is used to pivot the shutter 2 into the closed position.

If desired, a cylindrical sleeve 66 is also included with the window shutter opening and closing device 10. The sleeve 66 is placed over either the pin 32*c* during reassembly or it can instead be placed over the second shaft 52 that extends out of the enclosure 44 and which includes the flat end 54. When the flat end 54 engages with the slotted end 34, the entire enclosure 44 is urged slightly toward the center slat 6*c*. This ensures that the cylindrical sleeve 66 will pass over the slotted end 34. This prevents the slotted end 34 from opening an excessive amount due to a wedge action that is applied by the flat end 54. The cylindrical sleeve 66 also provides additional strength and durability to the retrofit assembly that has been described.

Figure 3:
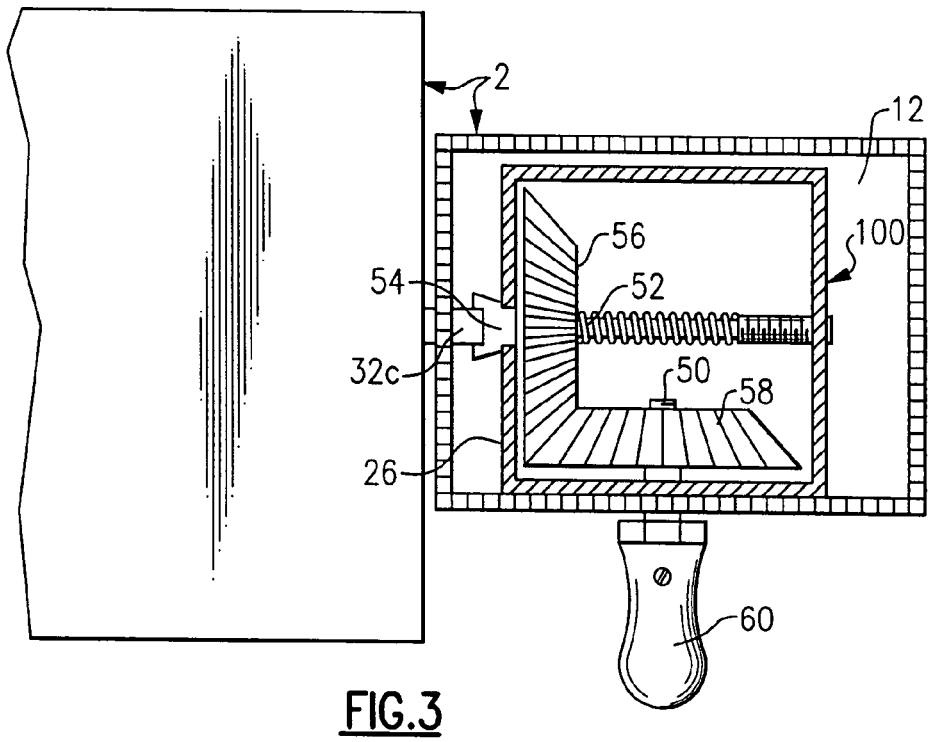
FIG. 3 is a cross section view of taken along the line 2-2 of FIG. 1 with the knob of FIG. 1 and a modified gear assembly that have both been installed.

Referring now also to FIG. 3, is shown, a modified type of a window shutter opening and closing device 100, installed in the channel 12 of a newly manufactured shutter 2. The modified device 100 is larger in size and is sized to fit in properly in the channel 12. If desired, it can be molded as part of the channel 12 or it can be added as an assembly component during fabrication of the shutter 2. Various modifications in the modified device 100 are possible and anticipated by the instant disclosure to better adapt if for use with any brand or type of the shutter 2, as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

For example, the color or style of the knob 60 is varied as desired to suit the particular aesthetic design requirements. Similarly, the position of the window shutter opening and closing device 10 within the channel 12 is varied as desired. If multiple shutters 2 are stacked one above the other, the location of the device 10 can be varied as desired. For example, the knob 60 (dashed lines) can be mounted proximate and attached in similar manner to the upper most slat 6*a* in the lower shutter 2. Installation and functioning of the device 10 remains the same. The location of the knob 60 can similarly be mounted proximate and attached to the lower most slat (not shown) in the upper shutter so that the two knobs 60 are disposed proximate each other. This can provide a more balanced appearance. The device 10 can be attached to any of the slats 6*a*-6*d*, as desired.

If desired, an electrical motor 102 can be included to rotate either of the shafts or one of the extension pins 32*a*-32*d* directly in response to a control signal that is applied to the motor 102. Power for the motor 102 is obtained either from batteries 104 disposed in the frame structure 4, a remote power source 106 (i.e., 120 VAC) and cord, or by a transformed located partially in the surrounding frame structure 108*a* and partially in the frame structure 108*b*, or any preferred combination. The knob 60 can be included as a manual control, or eliminated, as desired. If desired, a remote control 110 can be used to provide the control signal to actuate the motor 102 from a remote location.

What is claimed is:

1. A window shutter opening and closing device adapted for use with a window shutter of the type that includes a frame structure that supports and surrounds a plurality of pivotable slats, comprising:

(a) rotary means attached to said frame structure, said rotary means adapted for at least a limited amount of rotation about an axis; wherein said rotary means includes a drive gear cooperatively engaged with a driven gear; and (b) means for rotating one of said slats in response to a rotation of said rotary means and wherein said means for rotating one of said slats in response to a rotation of said rotary means includes means attached to said driven gear for rotating said one of said slats an amount proportionate that said driven gear is rotated; and including a first shaft attached to said drive gear, said first shaft including a center longitudinal axis that aligns with said axis about which said rotary means is adapted for at least a limited amount of rotation, and wherein a portion of said first shaft is adapted to extend through an opening in said frame structure to an exterior of said frame structure and wherein when said first shaft is rotated, said drive gear is rotated, and wherein when said drive gear is rotated, said driven gear is rotated a proportional amount, and including a second shaft attached to said driven gear and including means for attaching an end of said second shaft to said one of said slats wherein said one of said slats is rotated about a slat axis an amount that is proportionate with an amount that said second shaft is rotated, and wherein said means for attaching an end of said second shaft to said one of said slats includes a flat end at said end of said second shaft and a slot in an end of an extension pin, and wherein said extension pin is attached to said one of said slats, and wherein said flat end is adapted to engage with said slot in said end of said extension pin sufficient to rotate said extension pin when said second shaft is rotated.

2. The window shutter opening and closing device of claim 1 including a knob that is attached to said first shaft at an end of said first shaft that is disposed on said exterior of said frame structure.

3. The window shutter opening and closing device of claim 1 wherein said frame structure includes a channel that is disposed on a side of said frame structure that is distally located away from an opposite side of said frame structure.

4. The window shutter opening and closing device of claim 3 including an enclosure that is adapted to be inserted in said channel.

5. The window shutter opening and closing device of claim 4 including means for aligning said enclosure in said channel.

6. The window shutter opening and closing device of claim 5 wherein said means for aligning includes means for supplying a force to said enclosure when said enclosure is disposed in said channel in a desired direction.

7. The window shutter opening and closing device of claim 4 wherein said window shutter opening and closing device is adapted for inclusion with a preexisting type of a window shutter.

8. The window shutter opening and closing device of claim 4 wherein said window shutter opening and closing device is adapted for inclusion with a newly manufactured type of a window shutter.

9. The window shutter opening and closing device of claim 3 including a device hole passing through a perimeter wall of said channel and wherein a portion of said second shaft is adapted to extend through said device hole.

10. The window shutter opening and closing device of claim 1 wherein said drive gear includes a bevel type of a drive gear.

11. The window shutter opening and closing device of claim 1 wherein said driven gear includes a bevel type of a driven gear.

12. The window shutter opening and closing device of claim 1 wherein said shutter is of the type that includes at least one hinge, and wherein said frame structure is adapted to pivot about a hinge axis that passes through said at least one hinge from a closed position in which said frame structure is disposed proximate said window to an open position in which said frame structure is disposed maximally away from said window and wherein said window shutter opening and closing device includes a knob that is attached to said frame structure and wherein said knob is adapted to urge said shutter intermediate said open and said closed position.

* * * * *